US005778495A

United States Patent [19]

Paugh

[11] Patent Number: 5,778,495

[45] Date of Patent: Jul. 14, 1998

[54] BELT CLIP

[76] Inventor: Edward C. Paugh, 80 Huntington St., No. 608, Huntington Beach, Calif. 92648

[21] Appl. No.: 957,249

[22] Filed: Oct. 24, 1997

[51] Int. Cl.[6] ..... A44C 3/00; A45F 5/02

[52] U.S. Cl. ..... 24/3.12; 24/3.6; 24/3.11; 224/242; 224/269; 224/271

[58] Field of Search ..... 24/3.1, 3.11, 3.12, 24/3.6, 3.5, 11 R, 12, 13, 358, 362, 359, 367.1; 224/242, 269, 271

[56] References Cited

U.S. PATENT DOCUMENTS

| | | | |
|---|---|---|---|
| 1,454,468 | 5/1923 | Crosby | 24/3.11 |
| 4,214,686 | 7/1980 | Dostourian | 24/3.1 X |
| 4,881,150 | 11/1989 | Oyamada | 24/3.11 |
| 5,052,081 | 10/1991 | Fuehrer | 24/3.11 X |
| 5,385,282 | 1/1995 | Chen | 24/3.11 X |
| 5,452,497 | 9/1995 | Peng | 24/3.11 |
| 5,664,293 | 9/1997 | Bartoo | 24/3.12 |

*Primary Examiner*—Randolph A. Reese
*Assistant Examiner*—Robert J. Sandy
*Attorney, Agent, or Firm*—Pretty, Schroeder & Poplawski

[57] ABSTRACT

An attachment for mounting an object on a belt or the like, including a spring clip having a U-shape with first and second arms joined at a bight, an arrangement for mounting the first arm of the clip on a face of the object, a pin support carried on the object, the pin support having spaced arms projecting from the face of the object and aligned openings in the spaced arms, and a pin for positioning in the aligned openings for maintaining the free end of the second arm in position between the pin and the face of the object. The free end of the second arm has an inward bend towards the first arm and an outward bend away from the first arm defining a groove for receiving the pin.

4 Claims, 3 Drawing Sheets

FIG. 4
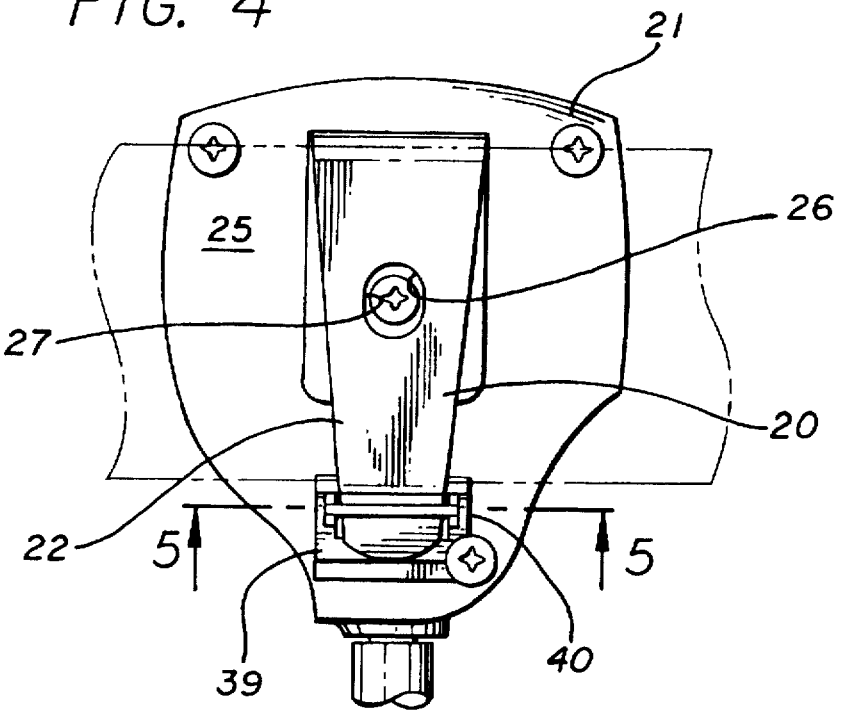
FIG. 5
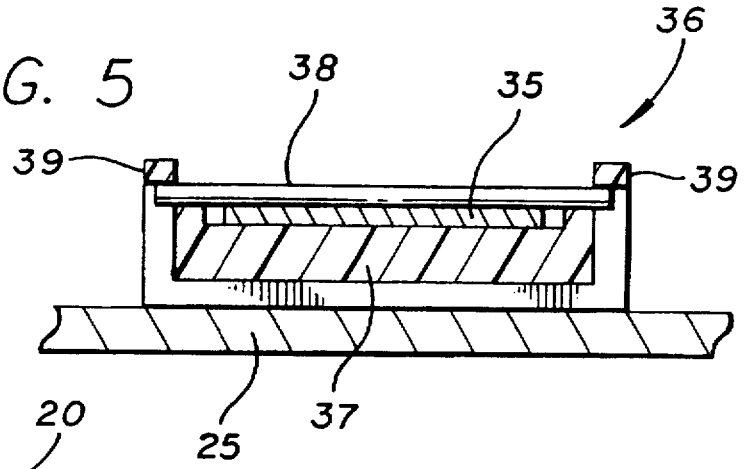
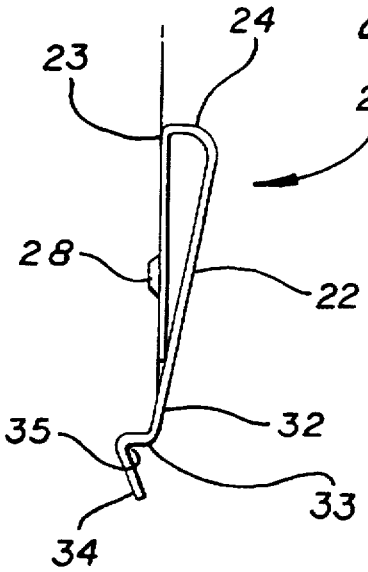
FIG. 6

BELT CLIP

BACKGROUND OF THE INVENTION

This invention relates to devices for attaching objects to belts, such objects including pouches, holsters, key chains, tapes, spring drive retractors, pagers and the like.

Two types of attachment devices are in use. In one type, the holster or other object to be supported on the belt is provided with a folded over spring steel clip, typically U-shaped, with the open end of the U of the clip sliding onto the belt or waist band. This type of attachment device is readily slid onto the belt and slid off of the belt, with the object being retained by the spring nature of the clip. One disadvantage of this type of object is the possibility of the clip sliding off of the belt.

In another form of attachment device, a closed loop of metal or plastic or cloth is used for carrying the holster or other device. The belt is fed through the closed loop prior to buckling or fastening the belt to itself. With this closed loop construction, there is little likelihood of loss or unauthorized removal of the holster and loop from the belt. However, the belt itself must be unfastened in order to position the loop on the belt and to remove the loop from the belt.

It is an object of the present invention to provide a new and improved attachment device which can be utilized as a loop type device and as a slide on clip type device, as desired by the user. With such a device, the user has the option at any time to have a clip type device or a loop type device.

Other objects, advantages, features and results will more fully appear in the course of the following description.

SUMMARY OF THE INVENTION

The attachment of the invention provides for mounting an object on a belt or the like, and includes a spring clip having a U-shape with first and second arms joined at a bight, mounting means for mounting the first arm of the clip on a face of the object, pin support means carried on the object and having means defining aligned openings, and a pin for positioning in the aligned openings for maintaining the free end of the second arm in position between the pin and the face of the object.

Preferably the free end of the second arm has an inward bend towards the first arm and an outward bend away from the first arm defining a groove for receiving the pin for converting the attachment from a clip type to a loop type.

Preferably the pin support means includes a body carried on the object with spaced arms defining the aligned openings for receiving the pin.

BRIEF DESCRIPTION OF THE DRAWINGS

FIG. 4 is a partial sectional view taken along the line 4—4 of FIG. 2;

FIG. 5 is an enlarged partial sectional view taken along the line 5—5 of FIG. 4;

FIG. 6 is a side view of the spring clip of the attachment device of the invention.

DESCRIPTION OF THE PREFERRED EMBODIMENTS

Figure 1:
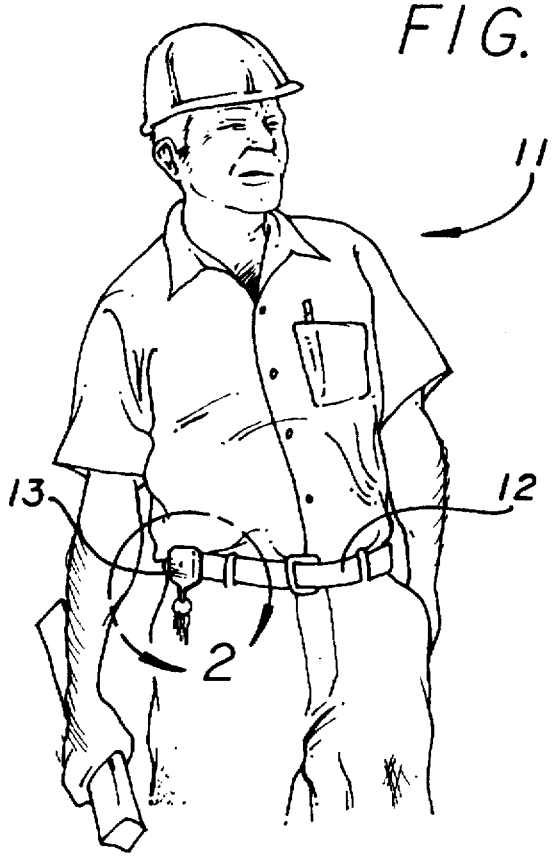
FIG. 1 is a view of an individual with a spring drive retractor for a key ring mounted a belt with the attachment device of the invention.
Figure 2:
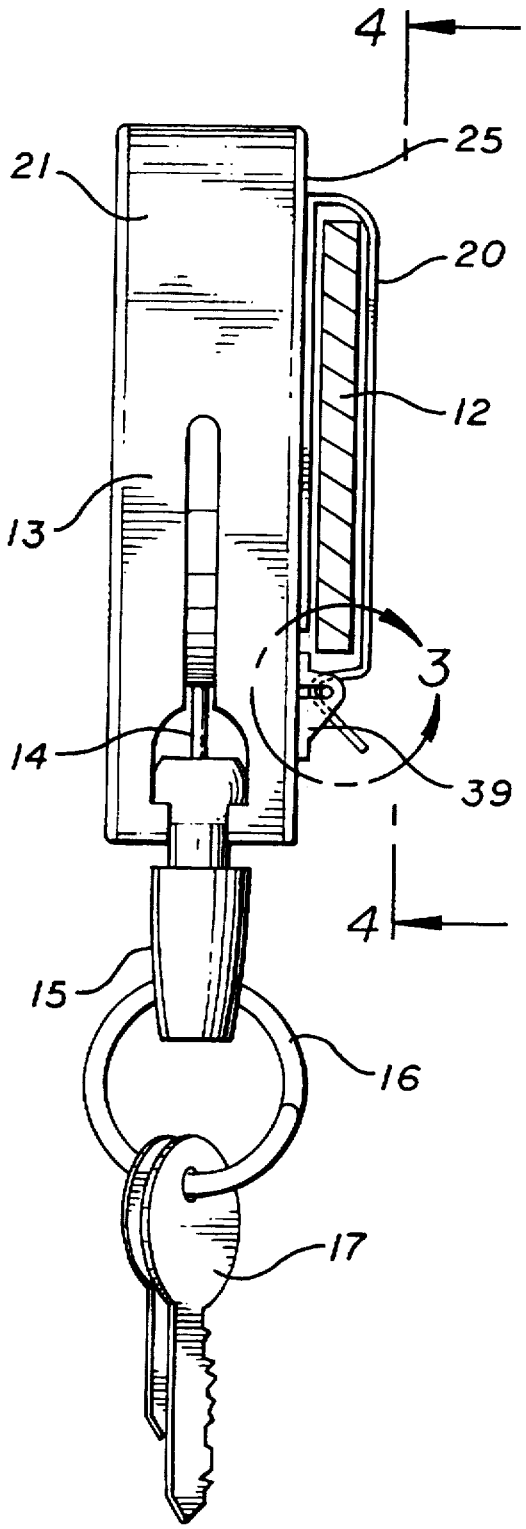
FIG. 2 is an enlarged partial sectional view of the structure in the circle 2 of FIG. 1.

In FIG. 1, a workman 11 is wearing a belt 12 with a spring driven key chain retractor 13 mounted on the belt. The retractor may be conventional in design and includes a cable 14 on a reel, a connector 15 at the outer end of the cable with a ring 16 fastened therein, and with several keys 17 carried on the ring.

A spring clip 20 is mounted on a face of the housing 21 of the retractor. The spring clip is typically made of spring steel in a U-shape with first and second arms 23, 22 joined at a bight 24. The clip 20 is attached to a face 25 of the housing 21 by a screw 26 which passes through a clearance opening 27 in the arm 22 of a clip and through a depressed opening 28 in the arm 23, into a threaded opening in the face 25.

The free end 32 of the arm 22 has an inward bend 33 toward the arm 23 and an outward bend 34 away from the arm 23, defining a groove 35.

Figure 7:
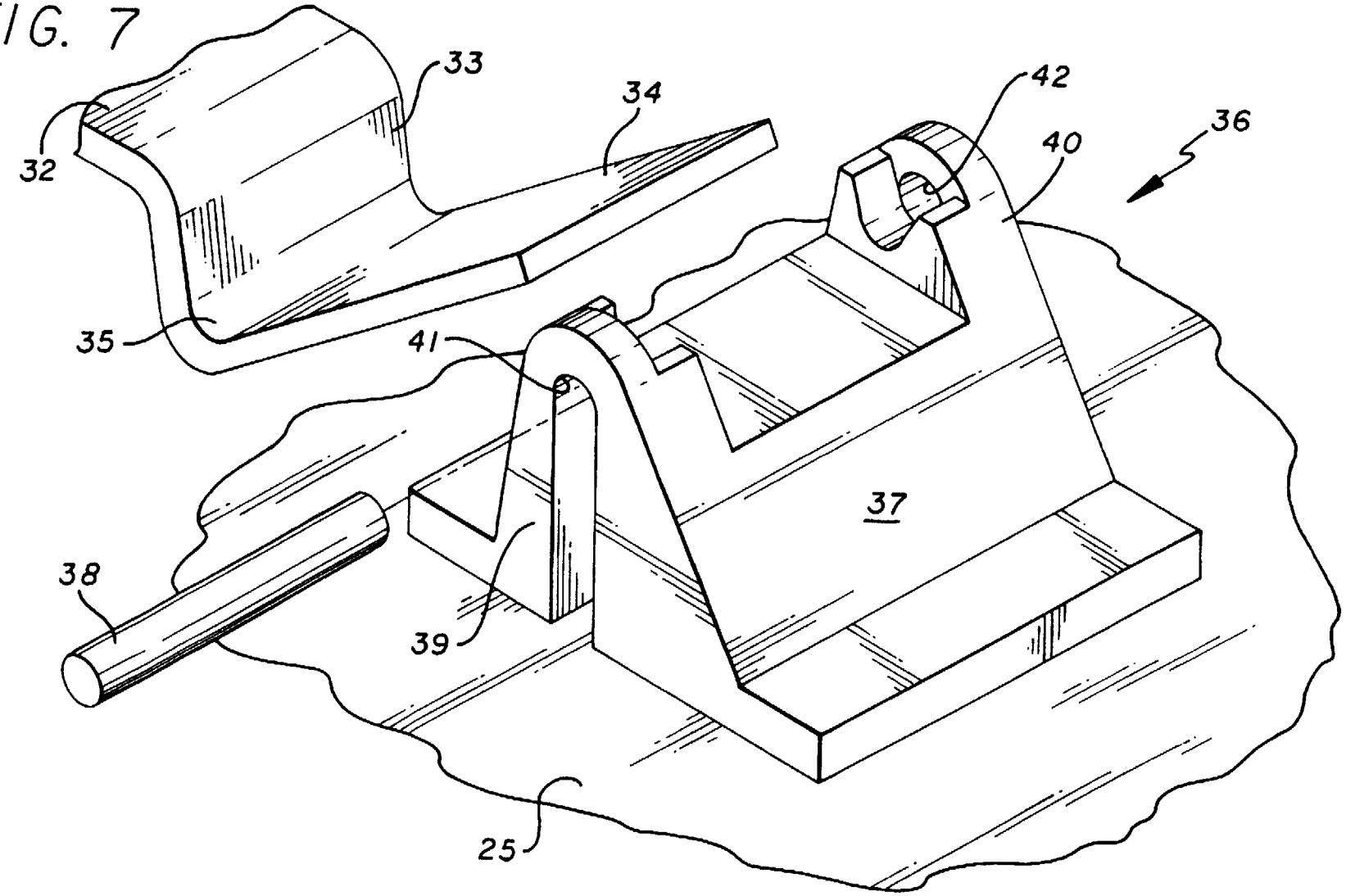
FIG. 7 is a perspective view of an attachment device.

A pin 38 may be positioned in pin support means 36 carried on and attached to the face 25 of the housing 21. The pin support means preferably includes a body 37 with spaced arms 39, 40 with aligned opening 41, 42 for receiving the pin 38. The pin support means is best seen in FIGS. 5 and 7.

In one embodiment, the pin 38 is a simple straight pin which is a push fit into the openings. In another embodiment, the pin may be a sleeve with sliding end members and an internal spring urging the end members outward. This construction is often utilized in watch bands and the like.

Figure 3:
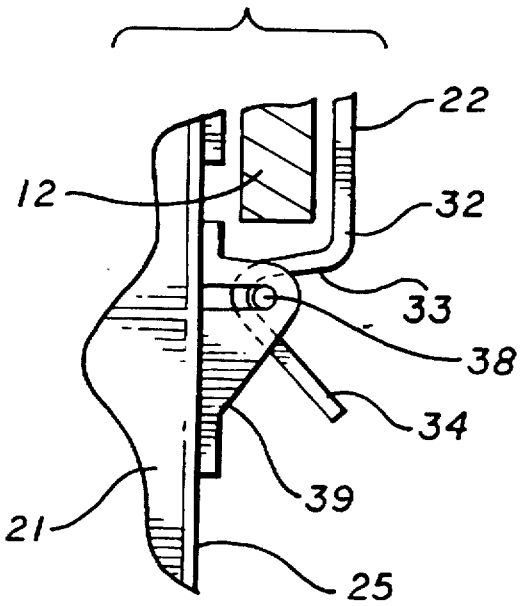
FIG. 3 is an enlarged partial sectional view of the portion in the circle 3 of FIG. 2.

With the construction of the invention, the user has the option of inserting the pin or leaving the pin out. With the pin omitted, the attachment device functions as a standard spring clip which is slid downward over the belt for installation and slid upward off the belt for removal. The user also has the option of utilizing the pin in place. The pin can be installed to form a loop and then the belt is slid through the loop. Alternatively, the clip can be slid down over the belt bringing the arm 22 into the position of FIG. 3, after which the pin is inserted, thereby locking the attachment device to the belt.

The provision of a mounting device with both clip and loop type connections permits manufacture, sale and use of a single model which permits the user to change back and forth between the two styles. Such novel design reduces manufacturing, shipping and storage, and retailing costs, and makes the product more attractive to users.

I claim:

1. An attachment for mounting an object on a belt or the like, including in combination:

a spring clip having a U-shape with first and second arms joined at a bight;

mounting means for mounting said first arm of said clip on a face of said object;

pin support means attached to said object, said pin support means having aligned openings; and a pin for positioning in said aligned openings for maintaining the free end of said second arm in position between said pin and said face of said object.

2. An attachment as defined in claim 1 wherein said free end of said second arm has an inward bend towards said first arm and an outward bend away from said first arm defining a groove for receiving said pin.

3. An attachment as defined in claim 2 wherein said pin support means includes a body carried on said object and spaced arms on said body defining said aligned openings for receiving said pin.

4. An attachment as defined in claim 1 wherein said pin support means includes a body carried on said object and spaced arms on said body defining said aligned openings for receiving said pin.

* * * * *